US006541173B1

(12) United States Patent
Kido et al.

(10) Patent No.: US 6,541,173 B1
(45) **Date of Patent: *Apr. 1, 2003**

(54) COLOR TONER FOR DEVELOPING ELECTROSTATIC IMAGE COMPRISING TWO KINDS OF POLYESTERS AND TWO KINDS OF RELEASING AGENTS

(75) Inventors: Kenichi Kido, Nishinomiya (JP); Masayuki Hagi, Mino (JP); Takeshi Arai, Akashi (JP); Yoshihiro Mikuriya, Nishinomiya (JP); Megumi Aoki, Itami (JP); Yoshitaka Sekiguchi, Nishinomiya (JP); Tetsuo Sano, Amagasaki (JP); Junichi Tamaoki, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/583,740

(22) Filed: May 31, 2000

(30) Foreign Application Priority Data

Mar. 6, 1999 (JP) ..... 11-156521

(51) Int. Cl.[7] ..... G03G 9/087; G03G 9/097

(52) U.S. Cl. ..... 430/109.4; 430/108.1; 430/108.4; 430/108.8; 430/137.18

(58) Field of Search ..... 430/106.6, 109, 430/110, 111, 137, 109.4, 108.1, 108.4, 108.8, 111.4, 137.18

(56) References Cited

U.S. PATENT DOCUMENTS

| | | | | |
|---|---|---|---|---|
| 4,142,982 A | | 3/1979 | Yamakami et al. | 252/62.1 |
| 4,533,614 A | * | 8/1985 | Fukumoto et al. | 430/109 |
| 4,590,139 A | | 5/1986 | Imai et al. | 430/45 |
| 4,657,837 A | | 4/1987 | Morita et al. | 430/109 |
| 4,863,824 A | | 9/1989 | Uchida et al. | 430/109 |
| 5,429,898 A | | 7/1995 | Sugizaki et al. | 430/45 |
| 5,541,030 A | | 7/1996 | Sano et al. | 430/106.6 |
| 5,578,409 A | * | 11/1996 | Kotai et al. | 430/109 |
| 5,660,963 A | | 8/1997 | Doujo et al. | 430/107 |
| 5,663,027 A | | 9/1997 | Kohri et al. | 430/114 |
| 5,776,647 A | * | 7/1998 | Kido et al. | 430/110 |
| 5,814,428 A | | 9/1998 | Kido et al. | 430/110 |
| 5,824,446 A | * | 10/1998 | Nishihara et al. | 430/110 |
| 5,843,605 A | | 12/1998 | Anno et al. | 430/45 |
| 5,908,726 A | | 6/1999 | Inoue et al. | 430/122 |
| 6,051,356 A | | 4/2000 | Nishihara et al. | 430/137 |

FOREIGN PATENT DOCUMENTS

| | | |
|---|---|---|
| EP | 0 662 640 A2 | 7/1995 |
| GB | 2 100 873 A | 1/1983 |
| JP | 60067958 A | 4/1985 |
| JP | 7-261459 | 10/1995 |

OTHER PUBLICATIONS

Grant, R. et al, ed. *Grant & Hackh's Chemical Dictionary*, 5th Edition, McGraw–Hill Book Co, Ny (1987), p 377.*
English Machine Translation of JP 7–261459 from Japanese Patent Office.
Derwent Acc. No. 1995–386471 for JP07261459A.
Copy of the as–filed Specification, Claims and Abstract of copending application Ser. No. 09/584,178 (Kenichi Kido et al), filed May 31, 2000.

* cited by examiner

*Primary Examiner*—Janis L. Dote
(74) *Attorney, Agent, or Firm*—Burns, Doane, Swecker & Mathis, LLP

(57) ABSTRACT

The present invention provide a toner comprising:

a coloring agent;

a binder resin comprising a first binder resin and a second binder resin, the first binder resin being composed of a linear polyester resin having a number-average molecular weight (Mn) of from 2,500 to 7,000, a weight-average molecular weight (Mw) of from 8,000 to 25,000, and a Mw/Mn ratio of 2 to 4, the second binder resin being composed of a non-linear polyester resin having a number-average molecular weight (Mn) of from 3,500 to 11,000, a weight-average molecular weight (Mw) of from 40,000 to 250,000, and a Mw/Mn ratio of 10 to 35, and a ratio of the first binder resin to the second binder resin (the first binder resin:the second binder resin) being 15:85 to 85:15 by weight, a first releasing agent having a softening point of 55 to 110° C., and a second releasing agent having a softening point of 110 to 160° C.

26 Claims, No Drawings

COLOR TONER FOR DEVELOPING ELECTROSTATIC IMAGE COMPRISING TWO KINDS OF POLYESTERS AND TWO KINDS OF RELEASING AGENTS

This application is based on application No. 156521/1999 filed in Japan, the contents of which are hereby incorporated by reference.

BACKGROUND OF THE INVENTION

1. Field of the Invention

The present invention relates to a color toner for developing electrostatic image suitably used in full color image-forming apparatuses such as a full color electrostatic copying machine, a full color laser beam printer and the like.

2. Description of the Related Art

In a full color image-forming method in electrophotography, the most significant properties required for toners were to have sharply melting properties so that toner layers of. various colors are instantaneously melted by heat, mixed and develop color in a fixing process in order to form full color images by laminating toner images of a magenta toner, a cyan toner, an yellow toner and a black toner (U.S. Pat. Nos. 4,142,982, 4,590,139 etc.). However, such toners had high viscosity, extremely low elasticity, and small intermolecular coagulation force when toners melted by heat, causing a problem of offset onto a heat roller (particularly, offset at higher temperatures). Such a problem was remarkable, particularly when a roller is deteriorated due to repeated use, and when images such as full color images (for example, photographic image) having a large toner-adhered area and having a large toner amount on a toner support member (such as paper and the like) are copied.

For the purpose of preventing offset phenomenon by improving the releasing properties from a roller, it has been known to use a material excellent in surface releasability and having lower surface energy as the surface material of a roller, and to apply a large amount of oil on the surface of a roller. When a full color toner having high viscosity is used in such an apparatus constitution, there were a lot of problems. Though prevention of offset is possible to a certain extent, a large amount of oil has to be applied for complete prevention of offset. Consequently, toner support members (paper etc.) are stained with the oil, the cost increases, further, accommodation and application of oil cause increase in size of a fixing apparatus, and the like. There was a further problem that when oil is applied on a fixing roller, the oil adheres to the surface of the resulted image to cause brilliance of copied images.

Therefore, there has been desired a color toner having constitution by which offset is not caused even if a large amount of oil is not applied. As trial for obtaining what is called an oil-less toner requiring no oil application onto a fixing roller, addition and inclusion of wax are known. However, in the case of a color toner, since the elasticity of the toner was too small relatively, ooze of wax in fairly large amount was necessary, and complete prevention of offset was impossible. Further, there as been tried to achieve sufficient offset-resistance with the addition of a small amount of wax, by allowing a color toner to have toner constitution showing relatively high viscosity and high elasticity as general monochrome toners. However, in such toner constitution, the toner can not be fully melted at relatively lower temperatures, causing big problems in fixing ability at low temperature, color-developing properties and color-mixing properties.

On the other hand, with the prevalence of color printers and copying machines having high image-quality, output pieces of color images increases dramatically, and further high speed is required. Under such recent conditions, toners giving small change of image gloss in continuous copying are in need. If change of image gloss is significant, appearances, namely, color and color reproducibility are felt changing significantly by person.

However, when a conventional toner of which sharply melting properties is emphasized is used, there is a problem that image gloss changes significantly in continuous copying. This problem becomes more remarkable by speedup of the copying. Such a gloss change is believed to be derived from lowering of fixing roller temperature due to gradual deprivation of heat on the surface of the fixing roller by paper. Further, when continuous copying is conducted using A4 paper at longitudinal direction before copying using A4 paper at transverse direction, change of gloss occurs on one piece of image paper, problematically. Specifically, when A4 paper is used at longitudinal direction, both end portions of a fixing roller are not used for fixing, whereas, when A4 paper is used at transverse direction, also both end portions of a fixing roller are used for fixing as well as center portions, therefore, temperature difference between the center portions and both end portions of a fixing roller occurs in copying at longitudinal direction of A4 paper, and when copying is conducted at longitudinal direction of A4 paper, high gloss portions and low gloss portions appear on copied images. The problems of gloss change by continuous copying and gloss change on copied images (hereinafter, simply referred to gloss change) as described above are particularly remarkable in cold regions and directly after switch on.

SUMMARY OF THE INVENTION

The present invention is to provide a color toner for developing electrostatic image excellent in offset-resistance, which can suppress offset without applying oil to a fixing roller.

Another object of the present invention is to provide a color toner for developing electrostatic image, which can suppress change of gloss due to change of fixing temperature, and has excellent offset-resistance and fixing properties at lower temperature.

The present invention relates to a toner for developing electrostatic image, comprising:

- a coloring agent;
- a binder resin comprising a first binder resin and a second binder resin, the first binder resin being composed of a linear polyester resin having a number-average molecular weight (Mn) of from 2,500 to 7,000, a weight-average molecular weight (Mw) of from 8,000 to 25,000, and a Mw/Mn ratio of 2 to 4, the second binder resin being composed of a non-linear polyester resin having a number-average molecular weight (Mn) of from 3,500 to 11,000, a weight-average molecular weight (Mw) of from 40,000 to 250,000, and a Mw/Mn ratio of 10 to 35, and a ratio of the first binder resin to the second binder resin (the first binder resin:the second binder resin) being 15:85 to 85:15 by weight,
- a first releasing agent having a softening point of 55 to 110° C., and
- a second releasing agent having a softening point of 110 to 160° C.

DETAILED DESCRIPTION OF THE INVENTION

The toner of the present invention comprises, at least, a binder resin, a coloring agent and a releasing agent, and uses two kinds of resins having different molecular weight (first binder resin; lower molecular weight, second binder resin; higher molecular weight,) as the binder resin.

The first binder resin is a linear polyester having a number-average molecular weight (in this specification, referred to as Mn) from 2,500 to 7,000, preferably from 2,500 to 6,000, more preferably from 2,800 to 6,000, a weight-average molecular weight (in this specification, referred to as Mw) from 8,000 to 25,000, preferably from 8,000 to 22,000, and a Mw/Mn ratio from 2.0 to 4.0, preferably from 2.1 to 3.9.

In the first binder resin, when Mn is less than 2,500 or Mw is less than 8,000, an effect for suppressing gloss change against change of fixing temperature is not obtained, and an effect to prevent offset at higher temperatures is not obtained. Further, lowering of Tg is caused, and toner storing properties (blocking-resistance) under high temperature deteriorates, in addition, the resin becomes too fragile, and in stirring in a developing vessel, a toner becomes a fine particles, deteriorating durability. When Mn is over 7,000 or Mw is over 25,000, heat-melting properties is inferior, fixing strength at relatively lower temperatures becomes weak, in addition, an image having appropriate gloss can not be obtained at relatively lower fixing temperatures. Further, resin becomes too hard, and pulverizing properties in producing a toner deteriorates. When Mw/Mn is lower than 2, the molecular weight distribution is too narrow, causing offset at higher temperatures in fixing. When Mw/Mn is over 4.0, fixing strength at relatively lower temperatures becomes weaker, in addition, an image having appropriate gloss can not be obtained at relatively lower fixing temperatures. Further, sharply melting properties decreases, the translucency and color-mixing properties of a toner decrease in the fixed image, the reproducibility of color deteriorates, and an excellent full color image can not be obtained. Further, by using a linear polyester as the first binder resin, the first binder resin can have sharply melting properties, and fixing properties at lower temperature when two kinds of resins are blended can be maintained. The linear polyester means a linear polyester having no branched chain.

In the present specification, the number-average molecular weight (Mn) and the weight-average molecular weight (Mw) of a resin are values measured by using gel permeation chromatography (GPC) (type 807-IT: made by Nippon Bunko Kogyo K.K.). Specifically, 30 mg of a sample to be measured is dissolved in 20 ml of tetrahydrofuran. This solution (0.5 mg) is introduced into an apparatus while keeping a column at 40° C. and passing tetrahydrofuran at 1 kg/cm$^2$ as a carrier solvent through the column. The molecular weights are calculated in terms of polystyrene.

It is desirable that the first binder resin in the present invention has a softening point (in the present specification, referred to as Tm) from 80 to 125° C., preferably from 85 to 115° C., more preferably from 90 to 110° C. and a glass transition point (in the present specification, referred to as Tg) from 45 to 80° C., preferably from 50 to 80° C., more preferably from 55 to 75° C., from the standpoints of the heat-resistance (blocking-resistance), fixing strength, color mixing properties and color reproducibility of a toner.

In the present specification, the softening point (Tm) of a resin is a value obtained according to the following method. First, 1.0 g of a sample to be measured is weighed, and measurement is conducted under conditions of a temperature-raising speed of 3.0° C./min., a pre-heating time of 180 seconds, a load of 30 kg and a measuring temperature range from 60 to 200° C. using a flow tester (CFT-500, made by Shimazu K.K.) and a die of h1.0 mm×ϕ1.0 mm, and the temperature when a half of the above-mentioned sample has flown out is measured as a softening point (Tm) of the resin.

The glass transition point (Tg) of a resin is a value obtained according to the following method. A differential scanning calorimeter (DSC-200, made by Seiko Denshi K.K.) is used. A sample (10 mg) to be measured is weighed precisely and placed in an aluminum pan. α-alumina as a reference is placed in the aluminum pan. They are heated from normal temperature to 200° C. at a temperature raising speed of 30° C./min., then, cooled. Measurement is conducted at a temperature raising speed of 10° C./min. within a range from 20° C. to 120° C. A shoulder value of the main absorption peak in a range from 30° C. to 100° C. in the temperature raising process is measured as Tg.

Monomers constituting the first binder resin are not particularly restricted provided that they can form a linear polyester, and for example, known divalent acid monomers and dihydric alcohol monomers can be used.

The divalent acid monomer is not particularly restricted provided that it has two carboxyl groups, and examples thereof include fumaric acid, maleic acid, maleic anhydride, phthalic acid, phthalic anhydride, terephthalic acid, isophthalic acid, tetrachlorophthalic anhydride, malonic acid, succinic acid, glutaric acid, dodecenylsuccinic anhydride, n-octylsuccinic acid, n-dodecenylsuccinic acid, adipic acid, sebacic acid, azelaic acid and lower alkyl esters of these acids. The divalent acid monomer may be used in combination of two or more.

In the present invention, as to the divalent acid monomers constituting the first binder resin, it is preferable to mix for use an aliphatic acid monomer and an aromatic acid monomer among the above-mentioned monomers. Particularly, it is more preferable that a molar ratio of an aliphatic acid monomer to an aromatic acid monomer (aliphatic acid monomer:aromatic acid monomer) is from 3:7 to 9:1, preferably from 3:7 to 8:2, from the standpoints of the sharply melting properties, fixing properties at lower temperature, pulverizing properties, heat-resistance (blocking-resistance), durability and offset-resistance of a toner.

Examples of the aliphatic acid monomer include fumaric acid, maleic acid, maleic anhydride, malonic acid, succinic acid, glutaric acid, dodecenylsuccinic anhydride, n-octylsuccinic acid, n-dodecenylsuccinic acid, adipic acid, sebacic acid, azelaic acid and lower alkyl esters of these acids, and they may be used in combination of two or more. Examples of the aromatic acid monomer include phthalic acid, phthalic anhydride, terephthalic acid, isophthalic acid and lower alkyl esters of these acids, and the like, and they may be used in combination of two or more.

The dihydric alcohol monomer is not particularly restricted providing it has two hydroxyl groups, and examples thereof include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, propylene glycol, dipropylene glycol, polyethylene glycol, polypropylene glycol, bisphenol A and derivatives thereof, hydrogenated bisphenol A, and the like. As the preferably dihydric alcohol monomer among these compounds, bisphenol A derivatives, particularly, polyoxypropylene(2.2)-2,2-bis(4-hydroxyphenyl)propane, polyoxyethylene(2.0)-2,2-bis(4-hydroxyphenyl)propane and the like.

The first binder resin can be produced by any known method. For example, above-described monomers are placed into a 4-necked flask. A reflux condenser, water-separating apparatus, nitrogen gas-introducing tube, thermometer and stirring apparatus are installed to this 4-necked flask. These are stirred for 5 to 15 hours to cause reaction, while introducing nitrogen into this flask through the above-mentioned nitrogen gas-introducing tube and simultaneously heating at 180 to 240° C. by a mantle heater. In this reaction, the reaction condition is traced by measuring an acid value. When a predetermined acid value is attained, the reaction is terminated to give a first binder resin. A molar ratio of the acid monomer to the alcohol monomer subjected to the reaction is about 5:5.

The second binder resin is a non-linear polyester having a Mn from 3,500 to 11,000, preferably from 4,000 to 10,000, a Mw from 40,000 to 250,000, preferably from 40,000 to 230,000, and a Mw/Mn ratio from 10 to 35, preferably from 10 to 30.

In the second binder resin, when Mn is less than 3,500 or Mw is less than 40,000, the elasticity is low, and an effect for suppressing gloss change against change of fixing temperature is not obtained. Whereas, when Mn is over 11,000 or Mw is over 250,000, extreme deterioration of fixing strength is invited, and in addition, an image having appropriate gloss can not be obtained at relatively lower fixing temperatures. When Mw/Mn is lower than 10, an effect for suppressing gloss change against change of fixing temperature is not obtained. When Mw/Mn is over 35, extreme deterioration of fixing strength is invited, and in addition, an image having appropriate gloss can not be obtained at relatively lower fixing temperatures. Further, by using a non-linear polyester as the second binder resin, behavior properties as elastomer can be imparted to the binder resin, being effective for gloss reduction and high temperature offset-resistance. The non-linear polyester means a branched polyester having a branched chain.

In the present specification, it is desirable that the second binder resin has a Tm from 105 to 155° C., preferably from 110 to 150° C., more preferably from 115 to 145° C. and a Tg from 55 to 85° C., preferably from 60 to 85° C., more preferably from 60 to 80° C., from the standpoints of the heat-resistance (blocking-resistance), fixing strength, color-mixing properties and color reproducibility of a toner.

Monomers constituting the second binder resin are not particularly restricted providing they can form a non-linear polyester, and for example, known polyvalent acid monomers and polyhydric alcohol monomers can be used.

The polyvalent acid monomer is not particularly restricted providing it has two or more carboxyl groups, and examples thereof include monomers exemplified as the above-mentioned divalent acid monomer, 1,2,4-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methyl-2-methylenecarboxylpropane, tetra(methylenecarboxy) methane, 1,2,7,8-octanetetracarboxylic acid, trimellitic acid, trimellitic anhydride, pyromellitic acid, pyromellitic anhydride and lower alkyl esters of these acid. The above-mentioned acid monomer may be used in combination of two or more.

In the present invention, it is more preferable to use, as the polyvalent acid monomers constituting the second binder resin, an aromatic acid monomer alone, among the above-mentioned monomers, from the standpoints of suppression of gloss change against change of the fixing temperature, heat-resistance (blocking-resistance), durability, and offset-resistance of a toner.

Among the above-mentioned polyvalent acid monomers, examples of the aromatic acid monomer include phthalic acid, phthalic anhydride, terephthalic acid, isophthalic acid, 1,2,4-benzenetricarboxylic acid, 1,2,4-naphthalenetricarboxylic acid, trimellitic acid, trimellitic anhydride, pyromellitic acid, pyromellitic anhydride and lower alkyl esters of these acid.

The polyhydric alcohol monomer is not particularly restricted providing it has two or more hydroxyl groups, and examples thereof include monomers exemplified as the above-mentioned dihydric alcohol monomer, glycerin, sorbitol, 1,4-sorbitan, trimethylolpropane and the like. Among them, examples of the preferable polyhydric alcohol monomer include bisphenol A derivatives, particularly, polyoxypropylene(2.2)-2,2-bis(4-hydroxyphenyl)propane, polyoxyethylene(2.0)-2,2-bis(4-hydroxyphenyl)propane and the like. The above-mentioned alcohol monomers may be used in combination of two or more.

In the present invention, it is preferable to use, as the monomer constituting the second binder resin, a not less than tri-valent monomer (including acid monomer and alcohol monomer) in a proportion of 3 to 50 mol %, preferably from 5 to 25 mol % based on the total amount of monomers constituting the second resin, and it is more preferable to use, as the not less than tri-valent monomer, the above-mentioned trivalent acid monomers from the standpoint of cost. Further, when a negatively chargeable toner is produced, it is advantageous to use a trivalent acid monomer from the standpoint of chageability.

The second binder resin can be produced by any known method, and the same methods as for producing the first binder resin can be adopted.

The first binder resin and the second binder resin as described above are used in a ratio by weight (first binder resin:second binder resin) of 15:85 to 85:15, preferably 20:80 to 80:20. When the proportion of the first binder resin based on the total amount of the first binder resin and the second binder resin is less than 15% by weight, fixing ability at lower temperature can not be maintained. Namely, when the fixing temperature is set at a relatively lower value, the fixing strength lowers, and an image having appropriately gloss can not be obtained. On the other hand, when the proportion is over 85% by weight, an effect for suppressing gloss change against change of the fixing temperature is not obtained.

In the present invention, other resins different from the first binder resin and the second binder resin may be mixed for use. The other resin is not particularly restricted providing it has compatibility or partial compatibility with the first binder resin and the second binder resin (for example, hybrid resin of styrene-acrylic acid copolymer and polyester). The usage of the other resin is suitably 10% by weight or less based on the mixed binder resin composed of the first binder resin, the second binder resin and the other resin.

The coloring agent constituting the toner of the present invention is not particularly restricted, and pigments and dyes conventionally known in the field of electrophotography can be used, and examples thereof include carbon black, aniline blue, chalcoil blue, chrome yellow, ultramarine blue, dupont oil red, quinoline yellow, methylene blue chloride, copper phthalocyanine, malachite green oxalate, lamp black, rose bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 180, C.I. Pigment Yellow 162, C.I. Pigment Blue 15:1, C.I. Pigment Blue 15:3, and the like.

The content of the coloring agent is not particularly restricted, and usually, it is desirably from 2 to 10 parts by weight based on 100 parts by weight of the binder resin.

In the present invention, it is preferable to use the coloring agent in the form of a master batch prepared by dispersing the coloring agent previously in a resin compatible with the binder resin used, from the standpoint of dispersibility in the toner particle. Specifically, a resin compatible with the binder resin used, preferably, the binder resin used and the coloring agent are mixed in a proportion of the coloring agent of about 15 to 50 parts by weight based on 100 parts by weight of the resin, the mixture is melted and kneaded, then, cooled and pulverized to give a master batch. The master batch is preferably the one which passed a 0.5 to 4.0 mm mesh, and the usage thereof may advantageously be such an amount that the amount of the pigment contained in a master batch used is within the above-mentioned range.

The toner of the present invention comprises a first releasing agent having a softening point from 55 to 110° C., preferably from 60 from 105° C., and a second releasing agent having a softening point from 110 to 160° C., preferably from 115 to 155° C. Due to inclusion of such two kinds of releasing agents having different softening points as described above, the first releasing agent effects to prevent offset at lower temperatures, and the second releasing agent effects to prevent offset at higher temperatures.

When the softening point of the first releasing agent is less than 55° C., though offset at lower temperatures can be prevented, an image having higher gloss than required is obtained. Further, due to a particle of the first releasing agent deposited on the surface of the toner particle, blocking-resistance deteriorates. On the other hand, when the softening point of the first releasing agent is over 110° C., a particle of the first releasing agent is not easily melted, and an effect to prevent offset at lower temperatures is not obtained, causing impossibility of fixing. Namely, since the lower temperature offset temperature is the fixing lower limit temperature, the fixing lower limit temperature substantially deteriorates.

When the softening point of the second releasing agent is lower than 110° C., an effect to prevent high temperature offset is small, and in addition, an image having higher gloss than required tends to be obtained. On the other hand, when over 160° C., a particle of the second releasing agent is not easily melted, causing significant deterioration of translucency thereof.

As the first releasing agent and the second releasing agent, known compounds conventionally used in the field of electrophotography as a releasing agent can be used, and for example, polyethylene wax, polyethylene wax of oxidation type, polypropylene wax, polypropylene wax of oxidation type, carnauba wax, Sazol wax, rice wax, candelira wax, jojoba oil wax, bees wax, ester wax and the like can be used. Among them, polyethylene wax, polypropylene wax, carnauba wax, ester wax and the like are preferably used. As the first releasing agent and the second releasing agent, the same kinds of wax or different kinds of wax may be used.

It is desirable that the content of the first releasing agent and the second releasing agent is respectively from 1 to 20 parts by weight, preferably from 1 to 15 parts by weight based on 100 parts by weight of the binding agent, from the standpoints of offset-resistance, wax-dispersing properties, toner chargeability, toner flowability and carrier spent. Further, it is desirable that the total content of the first releasing agent and the second releasing agent is 30 parts by weight or less, preferably from 2 to 24 parts by weight based on 100 parts by weight of the binding agent, from the standpoint of balance between offset-resistance, and wax-dispersing properties, toner flowability. Each of the first releasing agent and the second releasing agent may be used in combination of two or more, respectively, in this case, it may be advantageous that the total content of respective releasing agents is within the above-described range.

In the present invention, it is preferable to use the first releasing agent and the second releasing agent in the form of a master batch prepared by dispersing the releasing agent previously in a resin compatible with the binder resin used, from the standpoints of wax-dispersing properties in the toner particle, toner chargeability, image translucency, toner flowability and carrier spent. Specifically, a resin compatible with the binder resin used, preferably, the binder resin used and the releasing agent (first releasing agent and second releasing agent) are mixed in a proportion of the releasing agents of about 10 to 30 parts by weight based on 100 parts by weight of the resin, the mixture is melted and kneaded, then, cooled and pulverized to obtain a master batch. The master batch is preferably the one that passed a 0.5 to 4.0 mm mesh, and the usage thereof may advantageously be such amount that the amount of each releasing agent contained in a master batch used is within the above-mentioned range. By using the releasing agent as a master batch, the dispersibility in the toner particle is improved, therefore, a larger amount of the releasing agent can be contained without disturbing the charge uniformity of the toner. Further, reduction in productivity due to liberation of the releasing agent and adhesion of the releasing agent to a piping can be avoided.

In the present invention, it is more preferable to use the first releasing agent, second releasing agent and coloring agent in the form of a master batch (hereinafter, referred to as releasing agent-coloring agent master batch) prepared by dispersing them simultaneously in a resin compatible with the binder resin used, from the standpoints of production easiness. The method for producing a releasing agent-coloring agent master batch is not particularly restricted, providing the releasing agent and coloring agent can be dispersed uniformly in the resin, and it is possible that a releasing agent master batch containing dispersed releasing agents (first releasing agent and second releasing agent) is once obtained, this master batch is mixed with a coloring agent, the mixture is melted and kneaded, then, cooled and pulverized to obtain a releasing agent-coloring agent master batch.

The mixing ratio by weight of the resin with the first releasing agent, second releasing agent and coloring agent (master bacth component) in the releasing agent-coloring agent master batch may advantageously be such value that the mixing ratio by weight of the resin with the releasing agents (first releasing agent and second releasing agent) and the mixing ratio by weight of the resin with the coloring agent are within the above-mentioned ranges, respectively. It is preferable to use as the master batch the one which has passed 0.5 to 4 mm mesh, and the usage thereof may advantageously be such amount that each master batch component contained in the master batch used is within the above-mentioned range in the case of use of the component as it is.

In the present specification, the softening point of the releasing agent is a value obtained according to the following method. A differential scanning calorimeter (DSC-200, made by Seiko Denshi K.K.) is used, 10 mg of a sample to be measured is weighed precisely and placed in an aluminum pan, and $\alpha$-alumina as a reference is placed in the aluminum pan, they are heated from normal temperature to 200° C. at a temperature-raising speed of 30° C./min., then, cooled, and measurement is conducted at a temperature raising-speed of 10° C./min. within a range from 40° C. to 200° C., and the temperature at which the main heat absorption peak is shown in this temperature-raising process is measured as the softening point.

In the toner of the present invention, if necessary, a charge controlling agent, magnetic particles (only black toner) and the like can be appropriately compounded.

The toner of the present invention can contain, if necessary, a charge controlling agent for further stabilizing the chargeability thereof. The charge controlling agent is not particularly restricted, and a generally known negatively chargeable controlling agent which controls the toner to be charged negatively may be used. Examples thereof include metal complex of salicylic derivatives, calix arene-based compounds, organic boron compounds, fluorine-containing quaternary ammonium salt-based compounds, monoazo metal complex, aromatic hydroxycarboxylic acid-based metal complex, aromatic dicarboxylic acid-based metal complex and the like. Among them, colorless (white) compounds are suitably used for color toners. The content of the charge control agent is not particularly restricted, and usually, it is desirably from 0.5 to 5 parts by weight based on 100 parts by weight of the binder resin.

As the magnetic particles, iron particles, iron oxide particles, ferrite, nickel, magnetite and the like can be used. The content of the magnetic particles is not particularly restricted, and usually, it is desirably from 0.5 to 10 parts by weight based on 100 parts by weight of the binder resin.

The toner of the present invention can be produced by conventionally known methods, for example, a pulverization method, emulsifying dispersing granulation method and the like. The pulverization method is preferably adopted from the standpoints of production easiness and productivity. In the case of the pulverization method, for example, the above-mentioned binder resin, coloring agent and releasing agents, and if necessary, a charge control agent, and magnetic particles are mixed, melted, kneaded, cooled, roughly pulverized, finely pulverized, and classified to give a toner of the present invention. The volume-average particle size of the resulted toner of the present invention is preferably controlled to be 4 to 10 $\mu$m.

Further, to the toner of the present invention, external additives and cleaning agent may be added and mixed. When the external additive is used, examples thereof include a silica fine particle, titanium oxide fine particle, alumina fine particle, magnesium fluoride fine; particle, silicon carbide fine particle, boron carbide fine particle, titanium carbide fine particle, zirconium carbide fine particle, boron nitride fine particle, titanium nitride fine particle, zirconium nitride fine particle, magnetite fine particle, molybdenum disulfide fine particle, aluminum stearate fine particle, magnesium stearate fine particle, zinc stearate fine particle, calcium stearate fine particle, metal titanate fine particle, metal silicate fine particle and the like. It is preferable that the fine particles are hydrophobicized with a silane coupling agent, titanium coupling agent, higher fatty acid, silicone oil and the like before use. The usage of the external additive is preferably from 0.1 to 3.0% by weight based on the toner.

As the cleaning agent, there can be used various organic fine particles such as styrenic compound, acrylic compound, methacrylic compound, benzoguanamine, silicone, teflon, polyethylene, polypropylene and the like which have been granulated by gas phase methods or wet polymerization methods such as emulsion polymerization, soap free emulsion polymerization, non-water dispersion polymerization and the like.

The toner of the present invention can be used as a mono-component developing agent using no carrier and two-component developing agent using a carrier together. The use in the form of a two-component developing agent is preferable. As the carrier to be used together with the toner of the present invention, known carriers can be used. For example, any of carriers composed of magnetic particles such as iron particles, ferrite and the like, coated carriers obtained by coating the surface of magnetic particles with a coating agent such as a resin and the like, dispersion type carriers obtained by dispersing magnetic fine particles in a resin, and the like can be used. In the present invention, the preferably carrier has an average particle size from 20 to 70 $\mu$m, preferably from 30 to 60 $\mu$m.

The toner of the present invention is useful to a developing apparatus having a fixing machine using an oil-less fixing roller. Namely, even if the toner of the present invention is used in a developing apparatus in which oil is not applied on a fixing roller, a full color image having appropriate gloss can be obtained stably while suppressing change of image gloss following change of the fixing temperature, without causing a problem of offset (particularly, offset in fixing at higher temperature). Thus, the toner of the present invention can be applied to a developing apparatus having an oil-less fixing machine, therefore, problems such as staining of a toner-supporting member with oil, cost up, scale up of a fixing machine, and image brilliance and the like can be avoided. Further, the toner of the present invention also excellent in heat-resistance (blocking-resistance), lower temperature fixing properties, pulverization properties, color-mixing properties and color reproducing properties. As described above, though it is useful to apply the toner of the present invention to a developing apparatus having an oil-less fixing machine, the application object is not limited to the developing apparatus having an oil-less fixing machine, and that is, it can be effectively applied to a conventional developing apparatus in which the application amount of oil is reduced.

The following examples illustrate the present invention in more detail below, but do not limit the scope of the present invention.

EXAMPLE

Production of Binder Resin

As the binder resins in examples and comparative examples, first binder resins (lower molecular weight members) and second binder resins (higher molecular weight members) shown in Tables 1 and 2 were produced as described below. In producing the resins, as the alcohol monomer component, polyoxypropylene(2.2)-2,2-bis(4-hydroxyphenyl)propane (hereinafter, abbreviated as BPA-PO) and polyoxyethylene(2.0)-2,2-bis(4-hydroxyphenyl) propane (hereinafter, abbreviated as BPA-EO) were used, and as the acid monomer, terephthalic acid (hereinafter, abbreviated as TPA), fumaric acid (hereinafter, abbreviated as FA), trimellitic anhydride (hereinafter, abbreviated as TMA) were used.

Specifically, respective monomers were weighed so as to give molar ratios of monomers as shown in Table 1 and 2, and these were charged into a 2-liter 4-necked flask, and a reflux condenser, water-separating apparatus, nitrogen gas-introducing tube, thermometer and stirring apparatus were installed to this 4-necked flask, and these were stirred to cause reaction, while introducing nitrogen into this flask through the above-mentioned nitrogen gas-introducing tube and simultaneously heating by a mantle heater. In this reaction, the reaction temperature was from 180 to 240° C. In this reaction, the reaction condition was traced by measuring an acid value. When a predetermined acid value was attained, the reaction was terminated to give a binder resin (A-1 to A-10, and B-1 to B-11). In this procedure, the reaction time was from 5 to 15 hours. The number-average molecular weight (Mn), weight-average molecular weight (Mw), glass transition point (Tg), softening point and THF insoluble content (% by weight) of the resulted resin were measured, and shown in Tables 1 and 2, together with monomer composition rations (molar rations) of respective resins.

TABLE 1

| | First binder resin <lower molecular weight member> | | | | | | | | |
|---|---|---|---|---|---|---|---|---|---|
| | Monomer composition | | | | Resin physical value | | | | |
| | Acid monomer | | Alcohol monomer | | Molecular weight distribution | | | Heat properties | |
| Kind | FA | TPA | BPA-EO | BPA-PO | Mn | Mw | Mw/Mn | Tg | Tm |
| A-1 | 5 | 4 | 2 | 9 | 4500 | 15600 | 3.47 | 59.5° C. | 98.8°C. |
| A-2 | 5 | 4 | 4 | 7 | 3200 | 10800 | 3.38 | 55.2° C. | 90.8°C. |
| A-3 | 4.5 | 4.5 | 1 | 10 | 5600 | 21400 | 3.82 | 67.4° C. | 109.2°C. |
| A-4 | 6 | 3 | 5 | 6 | 4600 | 10200 | 2.22 | 57.2° C. | 92.4°C. |
| A-5 | 3 | 6 | 1 | 10 | 5900 | 19600 | 3.32 | 70.0° C. | 121.2°C. |
| A-6 | 9 | — | 8 | 3 | 3000 | 8800 | 2.93 | 51.0° C. | 82.5°C. |
| A-7 | 7 | 2 | 8 | 3 | 2300 | 7600 | 3.30 | 48.5° C. | 82.0°C. |
| A-8 | 4.5 | 4.5 | 0.5 | 10.5 | 7200 | 27000 | 3.75 | 65.4° C. | 114.3°C. |
| A-9 | 7 | 2 | 9 | 2 | 5100 | 9400 | 1.84 | 53.4° C. | 84.2°C. |
| A-10 | 4.5 | 4.5 | 1 | 10 | 4500 | 19200 | 4.27 | 66.5° C. | 111.4°C. |

TABLE 2

| | Second binder resin <higher molecular weight member> | | | | | | | | | |
|---|---|---|---|---|---|---|---|---|---|---|
| | Monomer composition | | | | | Resin physical value | | | | |
| | Acid monomer | | Alcohol monomer | | not less than trivalent | Molecular weight distribution | | | Heat properties | |
| Kind | FA | TPA | BPA-EO | BPA-PO | TMA | Mn | Mw | Mw/Mn | Tg | Tm |
| B-1 | — | 7 | 3 | 7 | 2 | 5400 | 79200 | 14.67 | 66.0° C. | 119.9° C. |
| B-2 | — | 5 | 2 | 9 | 4 | 8400 | 184200 | 21.93 | 74.1° C. | 139.4° C. |
| B-3 | — | 8 | 6 | 4 | 1 | 4200 | 54000 | 12.86 | 65.1° C. | 117.4° C. |
| B-4 | — | 6 | 1 | 9 | 3 | 4200 | 124600 | 29.67 | 69.8° C. | 130.2° C. |
| B-5 | — | 7 | 1 | 10 | 4 | 7500 | 224600 | 29.95 | 78.2° C. | 152.8° C. |
| B-6 | — | 7 | 9 | 1 | 2 | 4100 | 42500 | 10.37 | 59.2° C. | 109.4° C. |
| B-7 | 3 | 4 | 3 | 7 | 2 | 4200 | 52300 | 12.45 | 62.4° C. | 116.4° C. |
| B-8 | — | 8 | 6 | 4 | 1 | 3200 | 39000 | 12.19 | 60.6° C. | 118.4° C. |
| B-9 | — | 7 | — | 11 | 4 | 11200 | 273200 | 24.39 | 79.8° C. | 148.5° C. |
| B-10 | — | 8 | 6.5 | 3.5 | 1 | 5400 | 48300 | 8.94 | 61.8° C. | 116.2° C. |
| B-11 | — | 6 | 1 | 10 | 3 | 4300 | 156500 | 36.40 | 68.8° C. | 133.3° C. |

Examples 1 to 11 and Comparative Examples 1 to 14

For producing toners of Examples 1 to 11 and Comparative Examples 1 to 14, first binder resins and second binder resins shown in Tables 3 and 4 were dry blended by Henschel mixer at ratios by weight shown in Tables 3 and 4, and resulted blends were used as the binder resin.

In the examples and comparative examples, the above-mentioned binder resin used in the examples and comparative examples and a cyan coloring agent (C.I. Pigment Blue 15-3: made by Toyo Ink Seizo K.K.) were kneaded at a ratio of 7:3 (ratio by weight) by a pressure kneader, and the kneaded product was pulverized by a feather mill to give a coloring agent master batch (passed 2 mm mesh) which was used as the coloring agent.

The above-mentioned binder resin (93 parts by weigh), 10 parts by weight of the above-mentioned master batch, and releasing agents shown in Tables 3 and 4 were used in amounts shown, mixed with Henschel mixer, and this mixture was kneaded by a twin screw extrusion kneader. The kneaded product was cooled. This kneaded product was coarsely pulverized by a feather mill, further finely pulverized by a jet mill, and classified to give toner particles having a volume-average particle size of 7.8 $\mu$m. To the resulted toner particles, 0.8% by weight of hydrophobic silica (H2000; made by Clarient Corp.) and 1.0% by weight of hydrophobic titania A having a degree of hydrophobicity of 60% produced as described below were added as external additives. The resultant mixture was mixed by Henschel mixer to give a toner of Examples 1 to 11 and Comparative Examples 1 to 14.

Example 12

For producing a toner of Example 12, a first binder resin and a second binder resin shown in Table 3 were dry blended by Henschel mixer at a ratio by weight shown in Table 3 to give a binder resin used in this Example.

In Example 12, a first releasing agent, second releasing agent and coloring agent were used as a master batch obtained according to the following description. First, 100 parts by weight of the above-mentioned binder resin and 10 parts by weight of the first releasing agent and 10 parts by weight of the second releasing agent shown in Table 3 were kneaded by a pressure kneader. The kneaded product was pulverized by a feather mill to give a releasing agent master batch (passed 1.5 mm mesh). The resulted releasing agent master batch (100 parts by weight) and 30 parts by weight of a cyan coloring agent (C.I. Pigment Blue 15-3: made by Toyo Ink Seizo K.K.) were kneaded by a pressure kneader. The resulted kneaded product was pulverized by a feather mill to give a releasing agent-coloring agent master batch (passed 2.0 mm mesh).

A toner was obtained in the same manner as in Examples 1 to 11 and Comparative Examples 1 to 12, except that 93 parts by weight of the releasing agent master batch was used instead of the binder resin, and 10.0 parts by weight of the above-mentioned releasing agent-coloring agent master batch was used instead of the coloring agent master batch, the first releasing agent and the second releasing agent.

(Production of Hydrophobic Titania A)

Titania having an average primary particle size of 50 nm (STT-30; made by Titan Kogyo K.K.) was mixed by stirring in water, and to this was added n-hexyltrimethoxysilane in a such amount that the amount in terms of solid thereof was 20% by weight of the titania and they were mixed, and this mixture was dried and pulverized to give hydrophobic titania A having a degree of hydrophobicity of 60%.

TABLE 3

| | Binder resin | | | First releasing agent | | | Second releasing agent | | |
|---|---|---|---|---|---|---|---|---|---|
| | First binder resin | Second binder resin | A:B | Kind | Softening point | Addition amount (part) | Kind | Softening point | Addition amount (part) |
| Example 1 | A-1 | B-1 | 50:50 | Carnauba | 83° C. | 2.0 | 100TS | 145° C. | 5.0 |
| Example 2 | A-2 | B-2 | 80:20 | Carnauba | 83° C. | 5.0 | 100TS | 145° C. | 2.0 |
| Example 3 | A-3 | B-3 | 35:65 | Carnauba | 83° C. | 5.0 | 100TS | 145° C. | 5.0 |
| Example 4 | A-4 | B-4 | 80:20 | Carnauba | 83° C. | 2.0 | 100TS | 145° C. | 5.0 |
| Example 5 | A-1 | B-1 | 50:50 | WEC-2 | 60° C. | 2.0 | 550P | 150° C. | 1.5 |
| Example 6 | A-1 | B-1 | 50:50 | SPRAY105 | 105° C. | 3.0 | 100P | 121° C. | 5.0 |
| Example 7 | A-5 | B-1 | 50:50 | Carnauba | 83° C. | 2.0 | 100TS | 145° C. | 3.0 |
| Example 8 | A-6 | B-1 | 50:50 | Carnauba | 83° C. | 2.0 | 100TS | 145° C. | 3.0 |
| Example 9 | A-2 | B-5 | 50:50 | Carnauba | 83° C. | 2.0 | 100TS | 145° C. | 3.0 |
| Example 10 | A-3 | B-6 | 50:50 | Carnauba | 83° C. | 2.0 | 100TS | 145° C. | 3.0 |
| Example 11 | A-1 | B-7 | 50:50 | Carnauba | 83° C. | 2.0 | 100TS | 145° C. | 3.0 |
| Example 12* | A-1 | B-1 | 50:50 | Carnauba | 83° C. | 10.0 | 100TS | 145° C. | 10.0 |

*In Example 12, first releasing agent and second releasing agent were used in the form of a releasing agent-coloring agent master batch.

TABLE 4

| | Binder resin | | | First releasing agent | | | Second releasing agent | | |
|---|---|---|---|---|---|---|---|---|---|
| | First binder resin | Second binder resin | A:B | Kind | Softening point | Addition amount (part) | Kind | Softening point | Addition amount (part) |
| Com. Ex. 1 | A-7 | B-1 | 60:40 | Carnauba | 83° C. | 2.0 | 100TS | 145° C. | 5.0 |
| Com. Ex. 2 | A-8 | B-1 | 60:40 | Carnauba | 83° C. | 2.0 | 100TS | 145° C. | 5.0 |
| Com. Ex. 3 | A-9 | B-1 | 60:40 | Carnauba | 83° C. | 2.0 | 100TS | 145° C. | 5.0 |
| Com. Ex. 4 | A-10 | B-1 | 60:40 | Carnauba | 83° C. | 2.0 | 100TS | 145° C. | 5.0 |
| Com. Ex. 5 | A-1 | B-8 | 60:40 | Carnauba | 60° C. | 2.0 | 100TS | 145° C. | 5.0 |
| Com. Ex. 6 | A-1 | B-9 | 60:40 | Carnauba | 105° C. | 2.0 | 100TS | 145° C. | 5.0 |
| Com. Ex. 7 | A-1 | B-10 | 60:40 | Carnauba | 83° C. | 2.0 | 100TS | 145° C. | 5.0 |
| Com. Ex. 8 | A-1 | B-11 | 60:40 | Carnauba | 83° C. | 2.0 | 100TS | 145° C. | 5.0 |
| Com. Ex. 9 | A-1 | B-1 | 10:90 | Carnauba | 83° C. | 2.0 | 100TS | 145° C. | 5.0 |
| Com. Ex. 10 | A-1 | B-1 | 90:10 | Carnauba | 83° C. | 2.0 | 100TS | 145° C. | 5.0 |
| Com. Ex. 11 | A-1 | B-1 | 50:50 | 100P | 121° C. | 2.0 | 100TS | 145° C. | 3.0 |
| Com. Ex. 12 | A-1 | B-1 | 50:50 | Carnauba | 83° C. | 2.0 | SPRAY105 | 105° C. | 3.0 |
| Com. Ex. 13 | A-6 | B-2 | 50:50 | — | — | — | 100TS | 145° C. | 5.0 |
| Com. Ex. 14 | A-1 | B-1 | 50:50 | Carnauba | 83° C. | 2.0 | — | — | — |

In Tables 3 and 4, 100TS means polypropylene wax (100TS; made by Sanyo Kasei Kogyo K.K.), 550P means polypropylene wax (VISCOL 550P; made by Sanyo Kasei Kogyo K.K.), 100P means polyethylene wax (High Wax 100P; made by Mitsui Kagaku K.K), SPRAY105 means polyethylene wax (Polyethylene SPRAY105 made by Sazol K.K.), WEC-2 means polyester wax (ELECTOLE WEC-2; made by Nippon Yusi K.K), and "Carnauba" means carnauba wax (made by Sazol K.K).

As the carrier to be mixed with the above-mentioned toner, a resin-coated carrier produced as described below was used.

(Production Method for Carrier)

First, into a 500 ml flask equipped with a stirrer, condenser, thermometer, nitrogen-introducing tube and dropping funnel was added 100 parts by weight of methyl ethyl ketone. Separately, into 100 parts by weight of methyl ethyl ketone were dissolved 36.7 parts by weight of methyl methacrylate, 5.1 parts by weight of 2-hydroxyethyl methacrylate, 58.2 parts by weight of 3-methacryloxypropyltris(trimethylsiloxy)silane and 1 part by weight of 1,1'-azobis(cyclohexane-l-carbonitrile) under nitrogen atmosphere at 80° C., to give a solution. This solution was added dropwise into the above-mentioned flask over a period of 2 hours, and aged for 5 hours to give a resin. To the resulted resin was added isophorone diisocyanate/trimethylolpropane adduct (IPDI/TMP type: NCO %=6.1%) as a cross-linking agent so that OH/NCO molar ratio was 1/1, then, diluted with methyl ethyl ketone to give a coat resin solution having a solid proportion of 3% by weight. This coat resin solution was applied on a core material composed of calcined ferrite particles (F-300; made by Powder Tech K.K.) having an average particle size of 50 μm by Spira Coater (made by Okada Seiko K.K.) so that the coat resin amount was 1.5% by weight based on the core material. The coated material was dried, and the resulted carrier was left in a hot air cycling type oven at 160° C. for 1 hour for calcination. The calcined product was cooled, then, the ferrite powder bulk was pulverized by a sieve vibration apparatus equipped with a screen mesh having an opening of 106 μm and 75 μm, to give a resin-coated carrier.

To each (6 parts by weight) of the resulted toners was mixed 94 parts by weight of the above-mentioned resin coated carrier to give a starter. The following evaluations were conducted using this starter.

(Method for Measuring Image Glossiness)

Measurement of glossiness was conducted using a glossiness meter (GM-060; made by Minolta K.K.). Specifically, 1.5 cm×1.5 cm solid images <adhesion amount 2.0 mg/cm$^2$> were made by a full color copying machine (CF-900; made by Minolta K.K.) which had been modified into an oil-less fixing machine from which an oil application mechanism had been removed, while changing the image fixing temperature gradually by 2° C. in a range from 110° C. to 180° C., and the glossiness of each image was measured by a glossiness meter (GM-060; made by Minolta K.K.).

Evaluation Method (Lower Limit of Gloss-occurring Temperature)

The temperature at which glossiness reaches 15 which is the lower limit of the appropriate gloss was evaluated. When this temperature is less than 145° C., the evaluation is ◎, 145° C. or more and less than 150° C.: ○, 150° C. or more and less than 155° C.: Δ (practically no problem), and 155° C. or more: × (practically problematical)

(Glossiness Gradient)

The image glossiness against the fixing temperature obtained by the above-mentioned image glossiness measuring method was plotted (vertical axis; fixing temperature, horizontal axis; image glossiness), and an approximation line was drawn between a range from the lower limit glossiness 15 and the upper limit glossiness 40, and the gradient was measured. It is advantageous that this gradient is as low as possible. When the gradient is less than 1.5, the evaluation is ◎, when 1.5 or more and less than 1.6: ○, and when 1.6 or more: × (practically problematical).

(Fixing Lower Limit Temperature)

For this evaluation, 1.5 cm×1.5 cm solid images <adhesion amount 2.0 mg/cm$^2$> were made by a full color copying machine (CF-900; made by Minolta K.K.) which had been modified into an oil-less fixing machine from which an oil application mechanism had been removed, while changing the fixing temperature gradually by 2° C. in a range from 110° C. to 180° C., and; each image was folded at the center into two, and releasing of the image was visually evaluated, and the temperature between the fixing temperature at which the image was released slightly and the lower limit fixing temperature at which the image was not released at all was determined as the fixing lower limit temperature. When this fixing lower limit temperature is less than 145° C., the evaluation is ◎, 145° C. or more and less than 150° C.: ○, 150° C. or more and less than 155° C.: Δ (practically no problem), and 155° C. or more: × (practically problematical)

(High Temperature Offset Properties)

For this evaluation, half tone images were made by a full color copying machine (CF-900; made by Minolta K.K.) which had been modified into an oil-less fixing machine from which an oil application mechanism had been removed, at a half fixing system speed, while changing the fixing temperature gradually by 5° C. in a range from 130° C. to 200° C., and offset condition was visually evaluated, and the temperature at which offset occurred was evaluated. When this offset occurring temperature is 168° C. or more, the evaluation is ◎, 160° C. or more and less than 168° C.: ○, 155° C. or more and less than 160° C.: Δ (practically no problem), and less than 155° C.: × (practically problematical).

The evaluation results described above are shown below.

TABLE 5

| | Evaluation result | | | |
|---|---|---|---|---|
| | Lower limit gloss generation temperature | Glossiness gradient | Fixing lower limit temperature | High temperature offset |
| Example 1 | ◎ | ◎ | ◎ | ◎ |
| Example 2 | ○ | ◎ | ○ | ◎ |
| Example 3 | ○ | ◎ | ○ | ◎ |
| Example 4 | ◎ | ◎ | ◎ | ◎ |
| Example 5 | ◎ | ◎ | ◎ | ○ |
| Example 6 | ◎ | ◎ | ○ | ◎ |
| Example 7 | ○ | ◎ | Δ | ◎ |
| Example 8 | ◎ | ○ | ◎ | Δ |
| Example 9 | Δ | ◎ | Δ | ◎ |
| Example 10 | ◎ | ○ | ◎ | Δ |
| Example 11 | ◎ | ○ | ◎ | Δ |
| Example 12 | ◎ | ◎ | ◎ | ◎ |

TABLE 6

| | Evaluation result | | | |
|---|---|---|---|---|
| | Lower limit gloss generation temperature | Glossiness gradient | Fixing lower limit temperature | High temperature offset |
| Com. Ex. 1 | ◎ | x | ◎ | x |
| Com. Ex. 2 | x | ◎ | x | ◎ |
| Com. Ex. 3 | ◎ | ○ | ◎ | x |
| Com. Ex. 4 | x | ◎ | x | ◎ |
| Com. Ex. 5 | ◎ | x | ◎ | Δ |
| Com. Ex. 6 | x | ◎ | x | ◎ |
| Com. Ex. 7 | ◎ | x | ◎ | Δ |
| Com. Ex. 8 | x | ◎ | x | ◎ |
| Com. Ex. 9 | x | ◎ | x | ◎ |
| Com. Ex. 10 | ◎ | x | ◎ | Δ |
| Com. Ex. 11 | ◎ | ○ | x | ○ |
| Com. Ex. 12 | ◎ | ○ | ○ | x |
| Com. Ex. 13 | ○ | ○ | x[1)] | ○ |
| Com. Ex. 14 | ◎ | x | —[2)] | x |

[1)]Due to lower temperature offset generation

[2)]High temperature offset generation occurs at fairly lower temperature, and fixing lower limit temperature could not be measured (Method for Measuring Degree of Hydrophobicity)

In the present specification, the degree of hydrophobicity of an external additive was measured according to the following procedure. Into a 200 ml beaker was charged 50 ml of pure water. To this beaker was added 0.2 g of a sample to be measured. Methanol which had been dehydrated with anhydrous sodium sulfate was added to the beaker through a buret while stirring. Time when the sample was not recognized on the liquid surface was determined as the end point, and the degree of hydrophobicity was calculated according to the following formula using the amount (ml) of methanol required.

Degree of hydrophobicity=[used amount of methanol/(50+used amount of methanol)]×100

According to the present invention, a full color toner excellent in offset-resistance can be provided without applying oil on a fixing roller.

According to the present invention, a stable full color can be obtained while change of image gloss due to rising and lowering of fixing temperature is supressed.

According to the present invention, an image having excellent gloss can be obtained while maintaining lower temperature fixing properties.

What is claimed is:

1. A toner for a full color image-forming method comprising:

a coloring agent;

a binder resin comprising a first binder resin and a second binder resin, the first binder resin comprising a linear polyester resin consisting of polymerized divalent acid monomers and dihydric alcohol monomers and having a number-average molecular weight (Mn) of from 2,500 to 7,000, a weight-average molecular weight (Mw) of from 8,000 to 25,000, and a Mw/Mn ratio of 2 to 4, the second binder resin comprising a non-linear polyester resin having a number-average molecular weight (Mn) of from 3,500 to 11,000, a weight-average molecular weight (Mw) of from 40,000 to 250,000, and a Mw/Mn ratio of 10 to 35, and a ratio of the first binder resin to the second binder resin (the first binder resin:the second binder resin) being 15:85 to 85:15 by weight, a first releasing agent having a softening point of 55 to 110° C., and a second releasing agent having a softening point of 110 to 160° C.

2. The toner of claim 1, wherein said first binder resin has the number-average molecular weight of from 2,500 to 6,000, the weight-average molecular weight of from 8,000 to 22,000, and the Mw/Mn ratio of 2.1 to 3.9.

3. The toner of claim 1, wherein said second binder resin has the number-average molecular weight of from 4,000 to 10,000, the weight-average molecular weight of from 40,000 to 230,000, and the Mw/Mn ratio of 10 to 30.

4. The toner of claim 1, wherein said first binder resin has a softening point of 80 to 125° C. and a glass transition point of 45 to 80° C., and said second binder resin has a softening point of 105 to 155° C. and a glass transition point of 55 to 85° C.

5. The toner of claim 1, wherein the divalent acid monomers of said linear polyester resin are aliphatic acid monomers and aromatic acid monomers, and acid monomers of said non-linear polyester resin are selected from the group consisting of aromatic acid monomers.

6. The toner of claim 5, wherein a molar ratio of the aliphatic acid monomers to the aromatic acid monomers constituting said linear polyester resin (aliphatic acid monomer:aromatic acid monomer) is from 3:7 to 9:1.

7. The toner of claim 1, wherein a content of said first releasing agent is from 1 to 20 parts by weight based on 100 parts by weight of the binder resin, a content of said second releasing agent is from 1 to 20 parts by weight based on 100 parts by weight of the binder resin, and a total content of said first releasing agent and said second releasing agent is 30 parts by weight or less based on 100 parts by weight of the binder resin.

8. The toner of claim 1, wherein said first releasing agent has the softening point of 60 to 105° C., and said second releasing agent has the softening point of 115 to 155° C.

9. The toner of claim 1, which is selected from a cyan toner, a magenta toner, a yellow toner or a black toner.

10. The toner of claim 9, wherein said first binder resin has a number-average molecular weight of from 2,500 to 6,000, a weight-average molecular weight of from 8,000 to 22,000, and a Mw/Mn ratio of 2.1 to 3.9.

11. The toner of claim 9, wherein said second binder resin has a number-average molecular weight of from 4,000 to 10,000, a weight-average molecular weight of from 40,000 to 230,000, and a Mw/Mn ratio of 10 to 30.

12. The toner of claim 9, wherein said first binder resin has a softening point of 80 to 125° C. and a glass transition point of 45 to 80° C., and said second binder resin has a softening point of 105 to 155° C. and a glass transition point of 55 to 85° C.

13. The toner of claim 9, wherein the divalent acid monomers of said linear polyester resin are aliphatic acid monomers and aromatic acid monomers, and acid monomers of said non-linear polyester resin are selected from the group consisting of aromatic acid monomers.

14. The toner of claim 13, wherein a molar ratio of the aliphatic acid monomers to the aromatic acid monomers constituting said linear polyester resin (aliphatic acid monomer:aromatic acid monomer) is from 3:7 to 9:1.

15. The toner of claim 9, wherein said black toner contains 0.5 to 10 parts by weight of magnetic particles based on 100 parts by weight of the binder resin.

16. The toner of claim 1, wherein said second binder resin has the Mw/Mn ratio of 12.45 to 35.

17. The toner of claim 1, wherein said second binder resin has the Mw/Mn ratio of 12.86 to 35.

18. The toner of claim 1, wherein said first binder resin has the number-average molecular weight of from 2,800 to 6,000 and the weight-average molecular weight of from 8,000 to 22,000.

19. The toner of claim 1, wherein said coloring agent is a resin-dispersed coloring agent in which 15 to 50 parts by weight of the coloring agent are dispersed in 100 parts by weight of a resin compatible with said binder resin.

20. A toner selected from a cyan toner, a magenta toner, a yellow toner or a black toner used for forming a full color image, comprising:

a binder resin comprising a first binder resin and a second binder resin, the first binder resin comprising a linear polyester resin consisting of polymerized divalent acid monomers and dihydric alcohol monomers and having a number-average molecular weight (Mn) of from 2,500 to 7,000, a weight-average molecular weight (Mw) of from 8,000 to 25,000, and a Mw/Mn ratio of 2 to 4, the second binder resin comprising a non-linear polyester resin having a number-average molecular weight (Mn) of from 3,500 to 11,000, a weight-average molecular weight (Mw) of from 40,000 to 250,000, and a Mw/Mn ratio of 10 to 35, and a ratio of the first binder resin to the second binder resin (the first binder resin:the second binder resin) being 15:85 to 85:15 by weight, a resin-dispersed releasing agent in which 10 to 30 parts by weight of a releasing agent are dispersed in 100 parts by weight of said binder resin; said releasing agent comprising a first releasing agent having a softening point of 55 to 110° C. and a second releasing agent having a softening point of 110 to 160° C.

21. The toner of claim 20, wherein said resin-dispersed releasing agent is obtained though steps of mixing the binder resin and said releasing agent, melting and kneading the resulting mixture and pulverizing the resulting kneaded product.

22. The toner of claim 20, wherein said resin-dispersed releasing agent contains a coloring agent.

23. The toner of claim 22, wherein said resin-dispersed releasing agent is obtained through steps of mixing the binder resin and said releasing agent to give a first mixture, melting and kneading the first mixture to give a first kneaded product, pulverizing the first kneaded product, mixing the pulverized product with a coloring agent to give a second mixture, melting and kneading the second mixture to give a second kneaded product, and pulverizing the second kneaded product.

24. The toner of claim 20, wherein said first binder resin has a number-average molecular weight of from 2,500 to 6,000, a weight-average molecular weight of from 8,000 to 22,000, and a Mw/Mn ratio of 2.1 to 3.9, and said second binder resin has a number-average molecular weight of from 4,000 to 10,000, a weight-average molecular weight of from 40,000 to 230,000, and a Mw/Mn ratio of 10 to 30.

25. The toner of claim 20, wherein said second binder resin has the Mw/Mn ratio of 12.45 to 35.

26. The toner of claim 20, wherein said second binder resin has the Mw/Mn ratio of 12.86 to 35.

* * * * *